US012622487B2

(12) United States Patent
Bailly et al.

(10) Patent No.: US 12,622,487 B2
(45) Date of Patent: May 12, 2026

(54) SOLE STRUCTURE FOR ARTICLE OF FOOTWEAR

(71) Applicant: NIKE, Inc., Beaverton, OR (US)

(72) Inventors: Devin Bailly, Portland, OR (US); Paul Begyn, Beaverton, OR (US); Clayton Chambers, Portland, OR (US); Guercy Eugene, Portland, OR (US); Dervin A. James, Hillsboro, OR (US); Jason R. Meeker, Portland, OR (US); Benjamin J. Monfils, Portland, OR (US); Kevin C. Sze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/798,733

(22) Filed: Aug. 8, 2024

(65) Prior Publication Data

US 2025/0049175 A1 Feb. 13, 2025

Related U.S. Application Data

(60) Provisional application No. 63/518,765, filed on Aug. 10, 2023.

(51) Int. Cl.

| | |
|---|---|
| ***A43B 13/40*** | (2006.01) |
| ***A43B 7/1425*** | (2022.01) |
| ***A43B 7/144*** | (2022.01) |

(52) U.S. Cl.

CPC ..... *A43B 13/40* (2013.01); *A43B 7/1425* (2013.01); *A43B 7/144* (2013.01)

(58) Field of Classification Search

None

See application file for complete search history.

(56) References Cited

U.S. PATENT DOCUMENTS

| | | | | |
|---|---|---|---|---|
| 3,902,259 A * | 9/1975 | Cracco | A43B 3/24 | 36/11.5 |
| 4,317,294 A * | 3/1982 | Goodyear | A43B 13/36 | 36/36 B |
| 6,442,870 B1 * | 9/2002 | Tsai | A43B 3/103 | 36/15 |
| 7,246,453 B2 * | 7/2007 | Kim | A43B 21/39 | 36/15 |

(Continued)

FOREIGN PATENT DOCUMENTS

IT VR20100204 A1 4/2012

OTHER PUBLICATIONS

European Patent Office (Isa), International Search Report and Written Opinion for PCT App. No. PCT/US2024/041643, mailed Oct. 30, 2024.

*Primary Examiner* — Jila M Mohandesi

(74) *Attorney, Agent, or Firm* — Honigman LLP; Matthew H. Szalach; Jonathan P. O'Brien

(57) ABSTRACT

A sole structure for an article of footwear defines a footbed and includes a chassis having a lower cushioning element including an upper side and a bottom side disposed on an opposite side from the upper side, the lower cushioning element including one or more apertures extending from the upper side to the bottom side. A bladder is disposed adjacent to the upper side of the lower cushioning element and an outsole is disposed adjacent to the bottom side of the lower cushioning element and includes one or more protrusions each extending through a respective one of the one or more apertures and engaging the bladder.

20 Claims, 9 Drawing Sheets

(56) References Cited

U.S. PATENT DOCUMENTS

| | | | | |
|---|---|---|---|---|
| 9,486,036 | B1 * | 11/2016 | Douglas | A43B 23/0245 |
| 9,833,038 | B2 | 12/2017 | Foxen et al. | |
| 9,883,713 | B2 * | 2/2018 | Kawakami | A43B 3/24 |
| 11,758,978 | B2 * | 9/2023 | Bazan | A43B 13/30 36/15 |
| 2020/0375308 | A1 * | 12/2020 | Langvin | A43B 13/125 |
| 2021/0368918 | A1 * | 12/2021 | Lyke | A43B 13/223 |
| 2022/0104584 | A1 * | 4/2022 | Bazan | A43B 3/244 |
| 2023/0189926 | A1 | 6/2023 | Hardman et al. | |
| 2025/0221492 | A1 * | 7/2025 | Bandyopadhyay | A43B 13/20 |

* cited by examiner

SOLE STRUCTURE FOR ARTICLE OF FOOTWEAR

CROSS REFERENCE TO RELATED APPLICATIONS

This application claims priority under 35 U.S.C. § 119 (e) to U.S. Provisional Application No. 63/518,765, filed on Aug. 10, 2023. The disclosure of this prior application is considered part of the disclosure of this application and is hereby incorporated by reference in its entirety.

FIELD

The present disclosure relates generally to a sole structure for an article of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
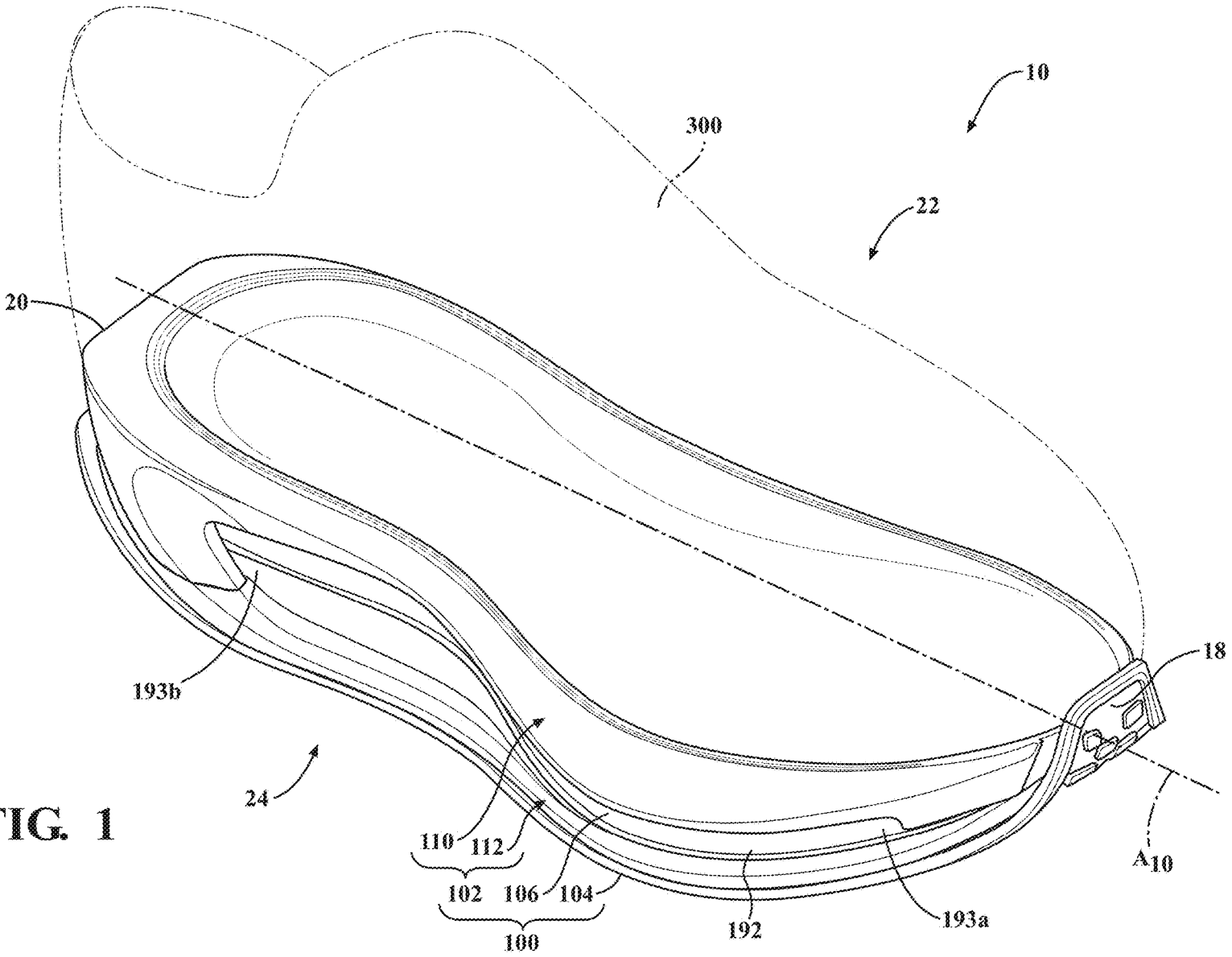
FIG. 1 is a lateral side perspective view of an article of footwear including an example of a sole structure in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

A sole structure for an article of footwear is provided. The sole structure defines a footbed and includes a chassis having a lower cushioning element including an upper side and a bottom side disposed on an opposite side from the upper side, the lower cushioning element including one or more apertures extending from the upper side to the bottom side. A bladder is disposed adjacent to the upper side of the lower cushioning element and an outsole is disposed adjacent to the bottom side of the lower cushioning element and includes one or more protrusions each extending through a respective one of the one or more apertures and engaging the bladder.

The sole structure may include one or more of the following optional features. For example, the one or more protrusions may include a first protrusion disposed on a medial side of the sole structure and a second protrusion disposed on a lateral side of the sole structure. Each of the first protrusion and the second protrusion may be aligned along a metatarsophalangeal axis of the sole structure.

In one configuration, each of the one or more protrusions may extend from a top side of the outsole to a distal end surface in contact with the bladder. In this configuration, the distal end surface may be planar. Additionally or alternatively, the bladder may include a first curved portion in a forefoot region of the sole structure and a substantially flat portion in a heel region of the sole structure. The distal end surface of each of the one or more protrusions may contact the bladder at the first curved portion.

The chassis may include an upper cushioning element disposed on an opposite side of the bladder from the lower cushioning element. The bladder may be exposed between the upper cushioning element and the lower cushioning element along at least one of a medial side of the sole structure or a lateral side of the sole structure. Additionally or alternatively, the bladder may be exposed between the upper cushioning element and the lower cushioning element at a posterior end of the sole structure.

In another configuration, a sole structure for an article of footwear is provided. The sole structure defines a footbed and includes a chassis having a lower cushioning element including an upper side and a bottom side disposed on an opposite side from the upper side, the lower cushioning element including a plurality of apertures extending from the upper side to the bottom side. A bladder is disposed adjacent to the upper side of the lower cushioning element and an outsole is disposed adjacent to the bottom side of the lower cushioning element and includes a plurality of protrusions each extending through a respective one of the plurality of apertures, supporting the bladder, and being offset from one another in a direction extending along a longitudinal axis of the sole structure.

The sole structure may include one or more of the following optional features. For example, the plurality of protrusions may include a first protrusion disposed on a medial side of the sole structure and a second protrusion disposed on a lateral side of the sole structure. Each of the first protrusion and the second protrusion may be aligned along a metatarsophalangeal axis of the sole structure.

In one configuration, each of the plurality of protrusions may extend from a top side of the outsole to a distal end surface in contact with the bladder. In this configuration, the distal end surface may be planar. Additionally or alternatively, the bladder may include a first curved portion in a forefoot region of the sole structure and a substantially flat portion in a heel region of the sole structure. The distal end surface of each of the plurality of protrusions may contact the bladder at the first curved portion.

The chassis may include an upper cushioning element disposed on an opposite side of the bladder from the lower cushioning element. The bladder may be exposed between the upper cushioning element and the lower cushioning element along at least one of a medial side of the sole structure or a lateral side of the sole structure. Additionally or alternatively, the bladder may be exposed between the upper cushioning element and the lower cushioning element at a posterior end of the sole structure.

Figure 3:
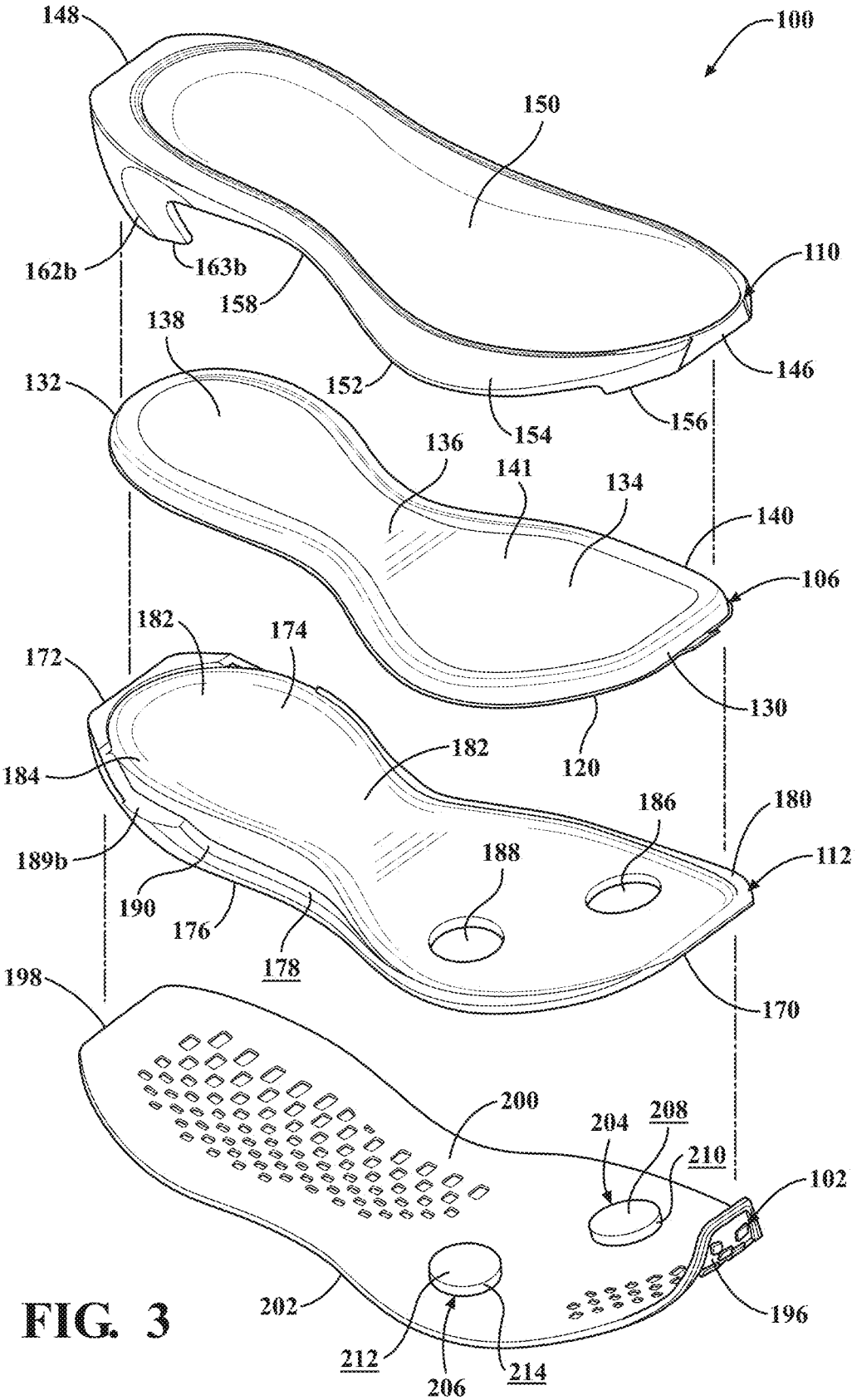
FIG. 3 is a top perspective exploded view of the sole structure of FIG. 1.
Figure 4:
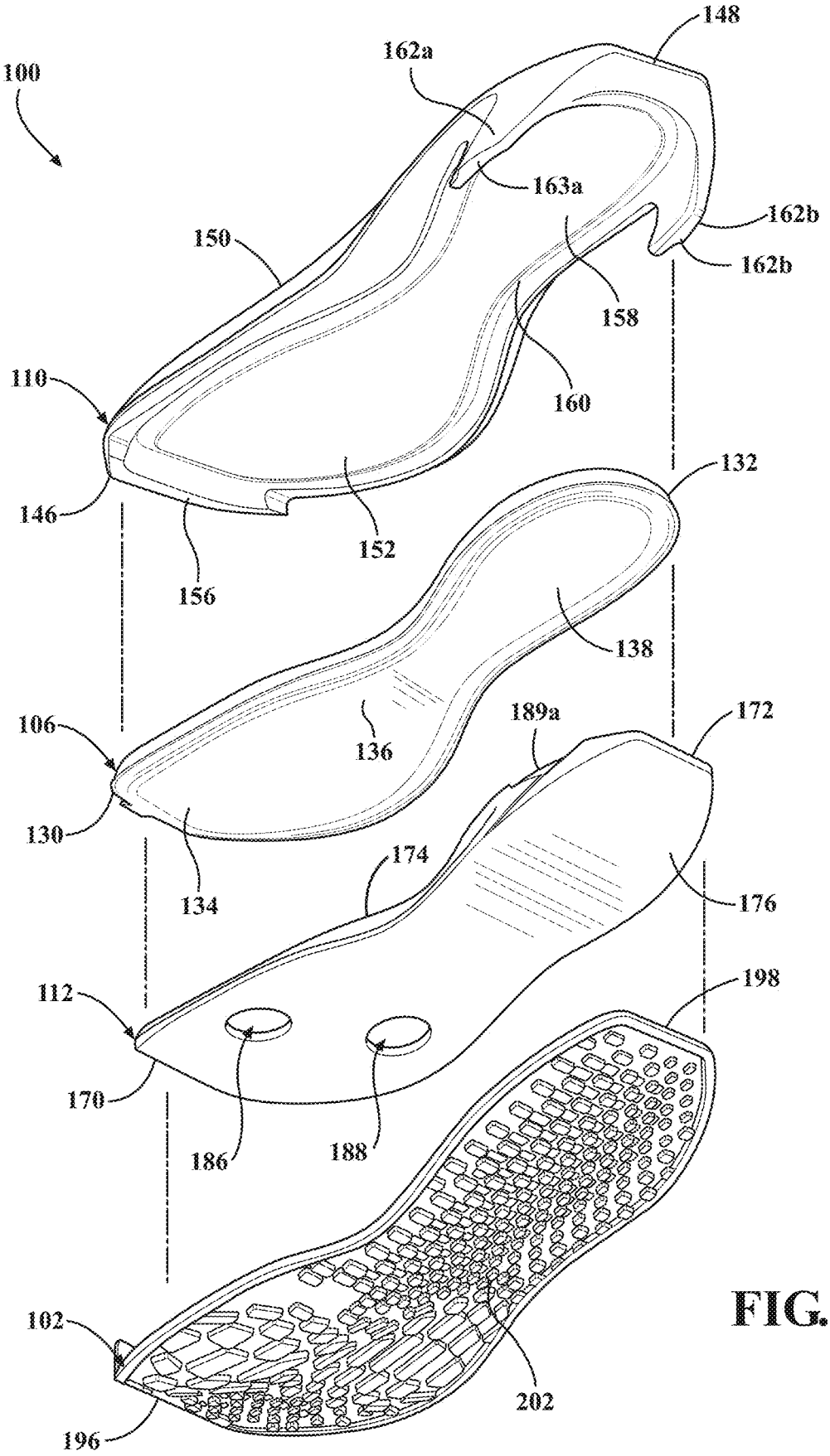
FIG. 4 is a bottom perspective exploded view of the sole structure of FIG. 1.
Figure 5:
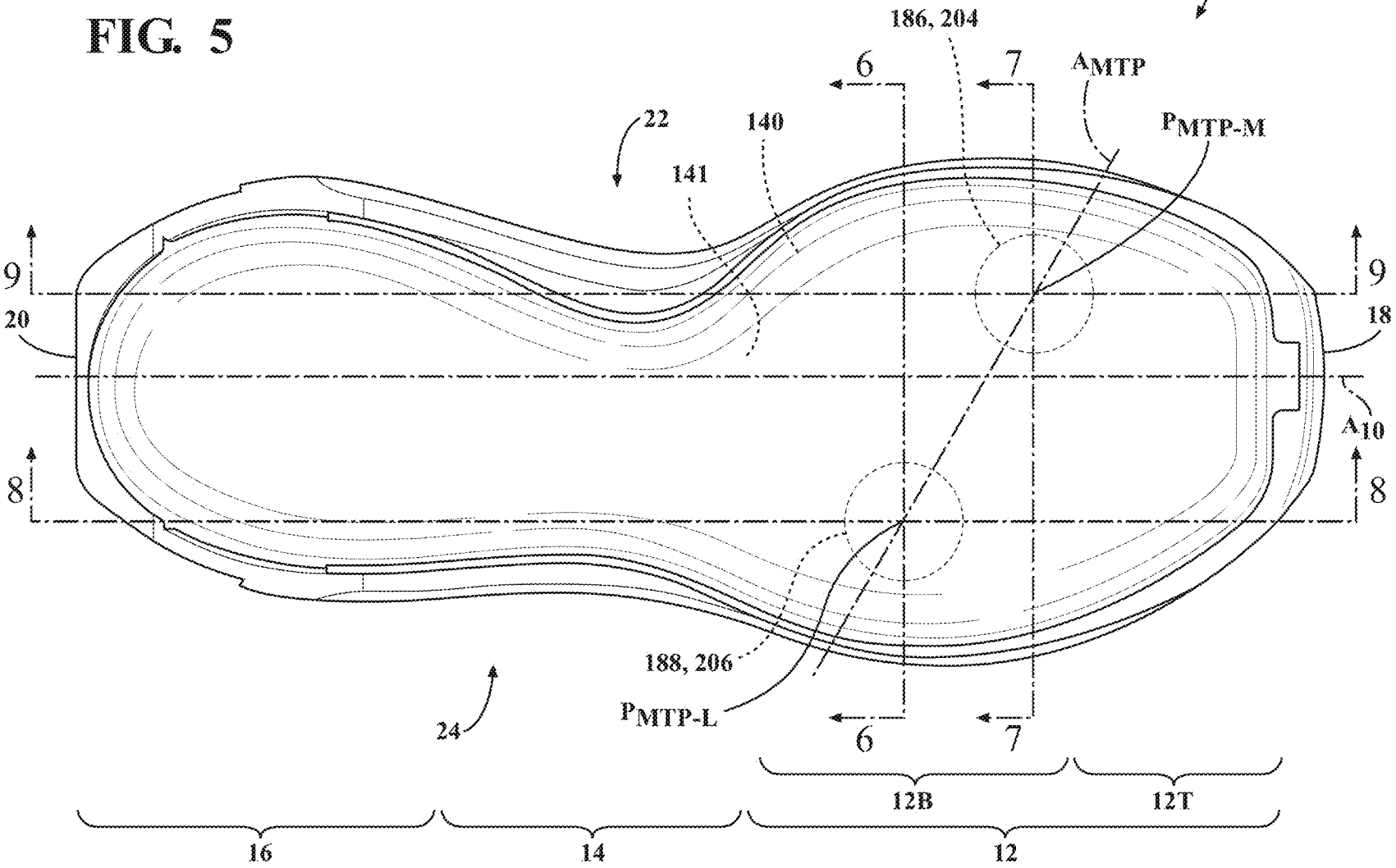
FIG. 5 is a top plan view of the sole structure of FIG. 1.

Referring to FIGS. 1-9, an article of footwear 10 is provided, which includes a sole structure 100 and an upper 300 attached to the sole structure 100. The article of footwear 10 may be divided into one or more regions. The regions may include a forefoot region 12, a mid-foot region 14, and a heel region 16. The forefoot region 12 may include a toe portion $\mathbf{12}_T$ corresponding to the phalanges and a ball portion $\mathbf{12}_B$ corresponding to the metatarsophalangeal joint (i.e., "the ball") of the foot. A metatarsophalangeal axis $A_{MTP}$ (FIG. 5) extends in a lateral direction of the sole structure 100 and corresponds to a metatarsophalangeal joint of the foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a medial side 22 and a lateral side 24, as shown in FIG. 5. Accordingly, the medial side 22 and the lateral side 24 respectively correspond with opposite sides of the footwear 10 and extend through the regions 12, 14, 16.

With reference to FIGS. 1-4, the sole structure 100 includes a midsole 102 configured to provide cushioning characteristics to the sole structure 100, and an outsole 104 configured to provide a ground-contacting surface 28 of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 may be described as including a bladder 106 and a chassis 108 (FIG. 1), where the chassis 108 is configured to be attached to the upper 300 and provides an interface between the upper 300, the bladder 106, and the outsole 104. In the illustrated example, the bladder 106 is supported within the chassis 108 between the outsole 104 and the upper 300.

Generally, the bladder 106 of the sole structure 100 is supported within the chassis 108 and is configured to attenuate forces associated with impacts along the length of the foot. The bladder 106 of the midsole 102 includes an opposing pair of barrier layers 114, 116, which are joined to each other along a peripheral seam 120 to define a chamber 118. In the illustrated configuration, the barrier layers 114, 116 include a first, upper barrier layer 114 defining an upper surface of the bladder 106 and a second, lower barrier layer 116 defining a lower surface of the bladder 106. Alternatively, the chamber 118 can be produced from any suitable combination of one or more barrier layers, as described in greater detail below.

As used herein, the term "barrier layer" (e.g., barrier layers 114, 116) encompasses both monolayer and multilayer films. In some embodiments, one or both of barrier layers the 114, 116 are each produced (e.g., thermoformed or blow molded) from a monolayer film (a single layer). In other embodiments, one or both of the barrier layers 114, 116 are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 114, 116 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 114, 116 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldipheny 1-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 114, 116 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 114, 116 include two or more sublayers, examples of suitable multilayer films include microlayer films, such as those disclosed in Bonk et al., U.S. Pat. No. 6,582,786, which is incorporated by reference in its entirety. In further embodiments, barrier layers 114, 116 may each independently include alternating sublayers of one or more TPU copolymer materials and one or more EVOH copolymer materials, where the total number of sublayers in each of the barrier layers 114, 116 includes at least four (4) sublayers, at least ten (10) sublayers, at least twenty (20) sublayers, at least forty (40) sublayers, and/or at least sixty (60) sublayers.

The chamber 118 can be produced from the barrier layers 114, 116 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 114, 116 can be produced by co-extrusion followed by vacuum thermoforming to produce an inflatable chamber 118, which can optionally include one or more valves (e.g., one way valves) that allows the chamber 118 to be filled with the fluid (e.g., gas).

The chamber 118 can be provided in a fluid-filled (e.g., as provided in footwear 10) or in an unfilled state. The chamber 118 can be filled to include any suitable fluid, such as a gas or liquid. In an aspect, the gas can include air, nitrogen ($N_2$), or any other suitable gas. In other aspects, the chamber 118 can alternatively include other media, such as pellets, beads, ground recycled material, and the like (e.g., foamed beads and/or rubber beads). The fluid provided to the chamber 118 can result in the chamber 118 being pressurized. Alternatively, the fluid provided to the chamber 118 can be at atmospheric pressure such that the chamber 118 is not pressurized but, rather, simply contains a volume of fluid at atmospheric pressure.

The fluid-filled chamber 118 desirably has a low gas transmission rate to preserve its retained gas pressure. In some embodiments, the fluid-filled chamber 118 has a gas transmission rate for nitrogen gas that is at least about ten (10) times lower than a nitrogen gas transmission rate for a butyl rubber layer of substantially the same dimensions. In an aspect, fluid-filled chamber 118 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 114, 116). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the upper barrier layer 114 and the lower barrier layer 116 cooperate to define a geometry (e.g., thicknesses, width, and lengths) of the chamber 118. For example the peripheral seam 120 may bound and extend around the chamber 118 to seal the fluid (e.g., air) within the chamber 118. Thus, the chamber 118 is associated with an area of the bladder 106 where interior surfaces of the upper and lower barrier layers 114, 116 are not joined together and, thus, are separated from one another. In the illustrated example, the bladder 106 includes a peripheral surface 115 that defines a peripheral profile of the bladder 106 and extends between a top surface defined by the upper barrier layer 114 and a bottom surface defined by the lower barrier layer 116.

Figure 6:
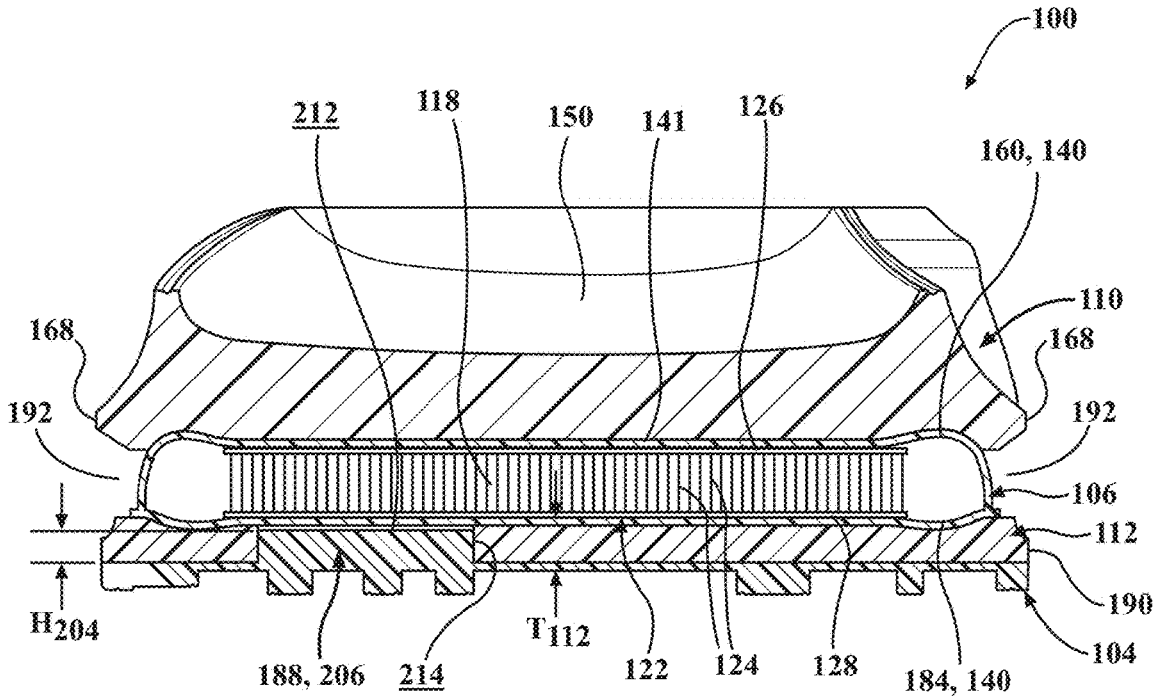
FIG. 6 is a lateral cross-sectional view of the sole structure of FIG. 1, taken along Line 6-6 of FIG. 5.
Figure 7:
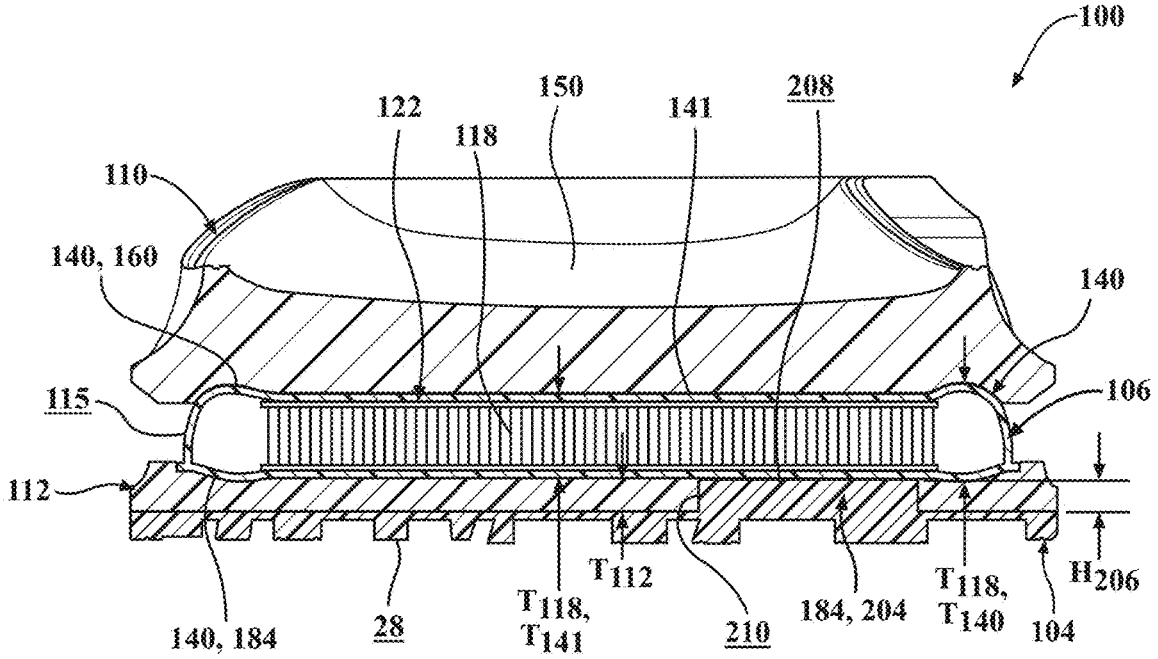
FIG. 7 is a lateral cross-sectional view of the sole structure of FIG. 1, taken along Line 7-7 of FIG. 5.
Figure 8:
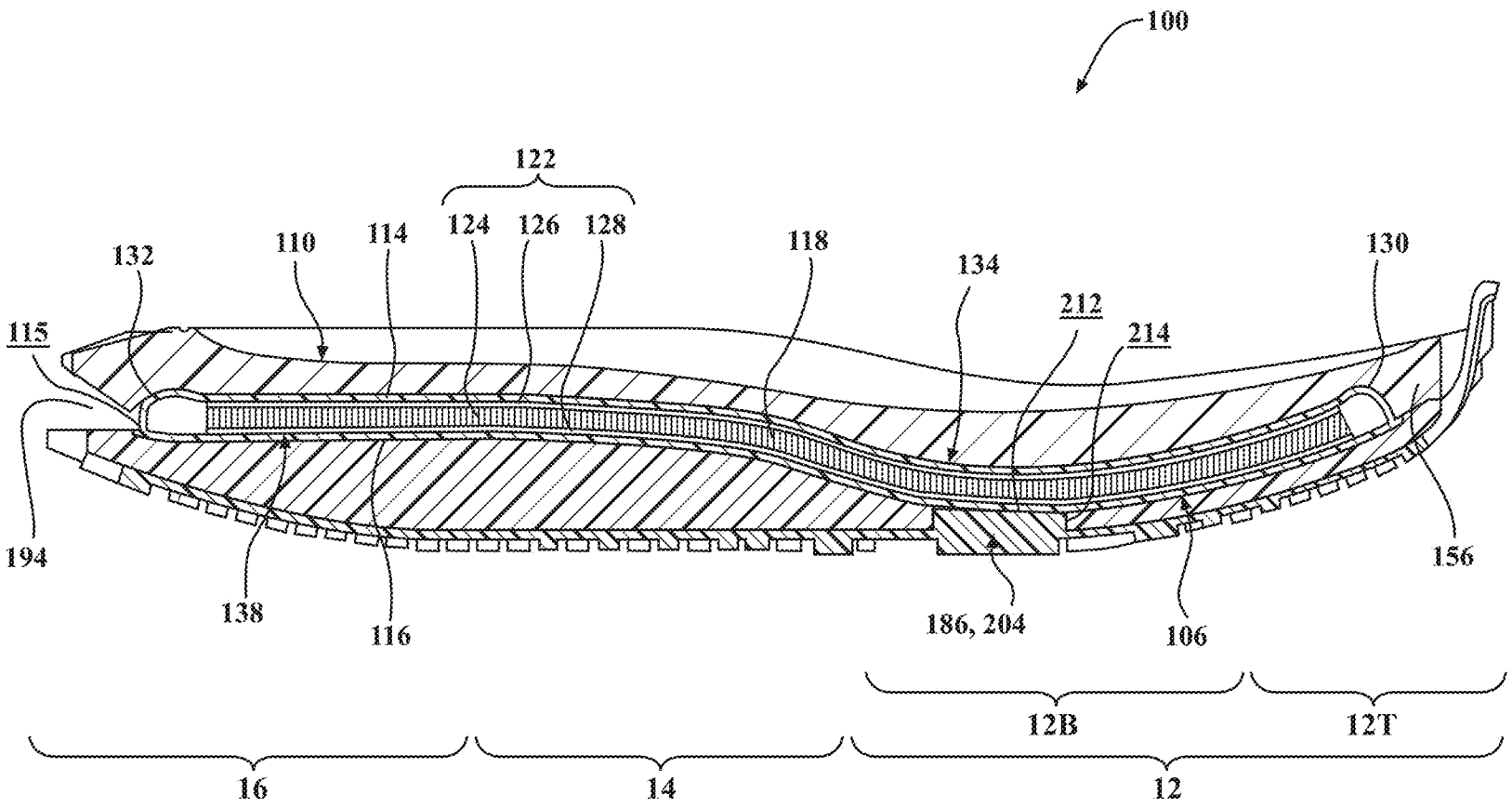
FIG. 8 is a longitudinal cross-sectional view of the sole structure of FIG. 1, taken along Line 8-8 of FIG. 5.

As shown in FIGS. 6-8, a space formed between opposing interior surfaces of the upper and lower barrier layers 114, 116 defines an interior void of the chamber 118. Similarly, exterior surfaces of the upper and lower barrier layers 114, 116 define an exterior profile of the chamber 118. Thicknesses $T_{118}$ of the chamber 118 are defined by the distance between the upper and lower barrier layers 114, 116 of the bladder 106.

The interior void of the chamber 118 may receive a tensile element 122 therein. The tensile element 122 may include a series of tensile strands 124 extending between an upper tensile sheet 126 and a lower tensile sheet 128. The upper tensile sheet 126 may be attached to the upper barrier layer 114 while the lower tensile sheet 128 may be attached to the lower barrier layer 116. In this manner, when the chamber 118 receives a pressurized fluid, the tensile strands 124 of the tensile element 122 are placed in tension. Because the upper tensile sheet 126 is attached to the upper barrier layer 114 and the lower tensile sheet 128 is attached to the lower barrier layer 116, the tensile strands 124 retain a desired shape of the chamber 118 when the pressurized fluid is injected into the interior void of the chamber 118.

Figure 9:
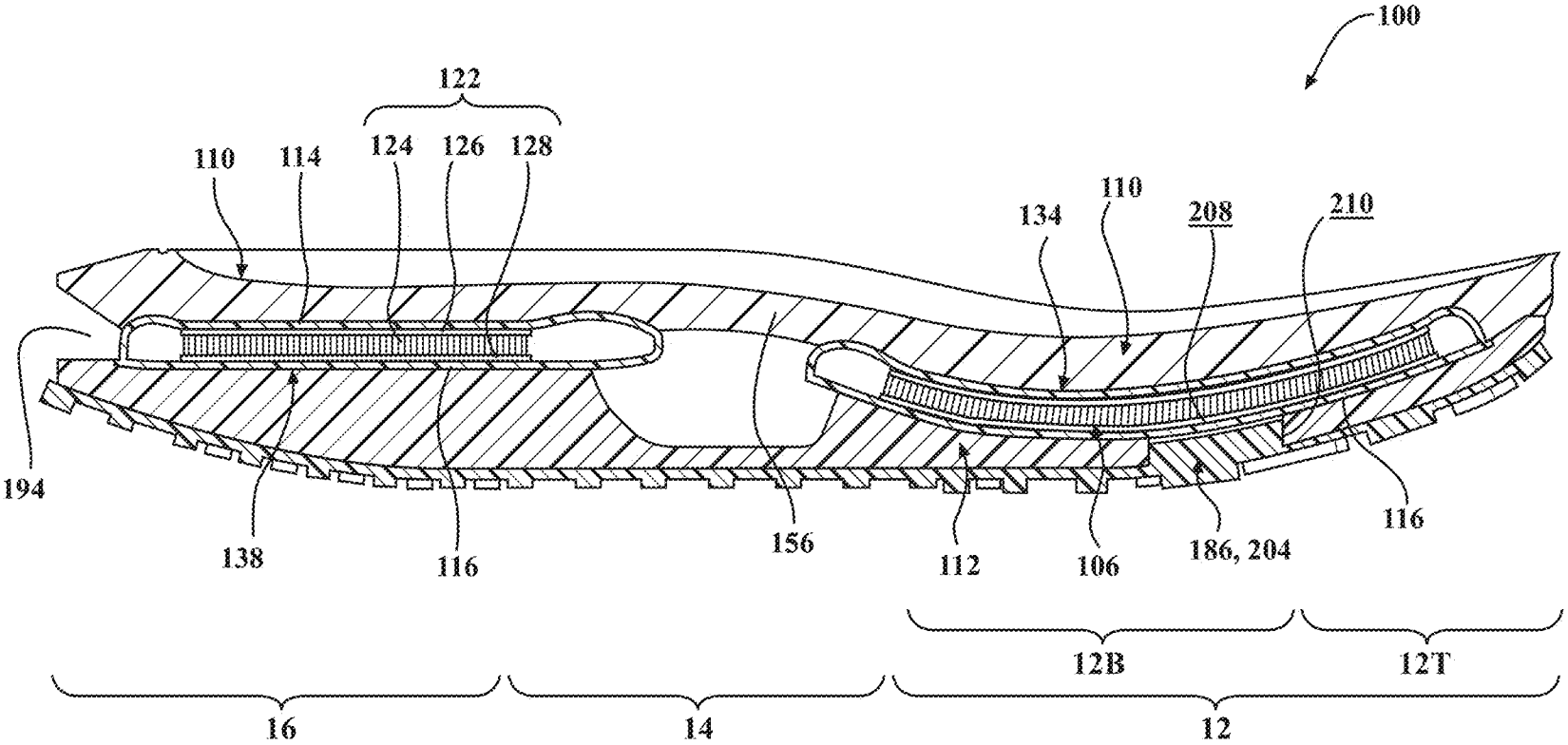
FIG. 9 is a longitudinal cross-sectional view of the sole structure of FIG. 1, taken along Line 9-9 of FIG. 5.
Figure 10:
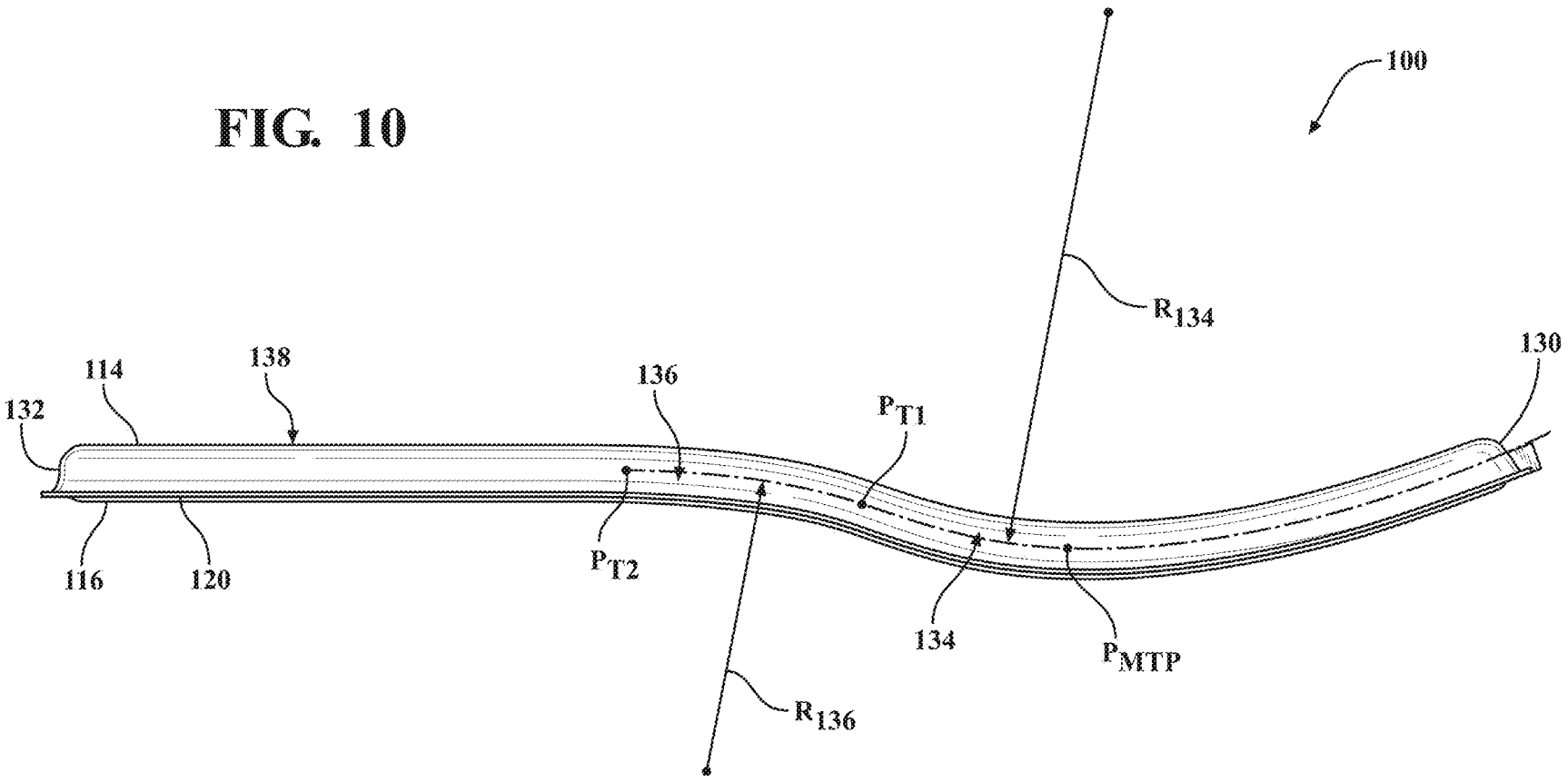
FIG. 10 is a lateral side elevation view of an example of a bladder of the sole structure of FIG. 1.

With reference to FIGS. 8-10, the bladder 106 may be described as having a length extending from a first end 130 to a second end 132. When the bladder 106 is incorporated into the sole structure (FIGS. 8 and 9), the first end 130 defines an anterior-most point of the bladder 106 and the second end 132 defines a posterior-most point of the bladder 106. The bladder 106 further includes a first arcuate or curved portion 134 disposed adjacent to the first end 130, a second arcuate or curved portion 136 disposed adjacent to the first curved portion 134, and a substantially flat portion 138 extending from the second curved portion 136 to the second end 132. In other words, the second curved portion 136 is disposed between and connects the first curved portion 134 and the substantially flat portion 138.

Referring still to FIGS. 8-10, when the bladder 106 is incorporated into the sole structure 100, the first curved portion 134 defines a concave curvature relative to a footbed of the sole structure 100 such that the concave curvature defines a concave surface opposing the upper 300. Here, the first curved portion 134 extends from the first end 130 of the bladder 106 in the toe portion $12_T$ of the forefoot region 12, through a metatarsophalangeal (MTP) point $P_{MTP}$ associated with the metatarsophalangeal joint of the foot, and to a first transition point $P_{T1}$ in the mid-foot region 14. As shown, the MTP point $P_{MTP}$ defines a lowermost point of the first curved portion 134. The first curved portion 134 may define a constant radius of curvature extending continuously from the first end 130 to the first transition point $P_{T1}$.

The second curved portion 136 defines a convex curvature relative to the footbed of the sole structure 100 (i.e., concave with respect to the ground-contacting surface 28) such that the convex curvature defines a convex surface that opposes the upper 300. As shown in FIG. 10, the second curved portion 136 extends from the first transition point $P_{T1}$ in the mid-foot region 14 to a second transition point $P_{T2}$ in the mid-foot region 14. Optionally, the second curved portion 136 may define a constant radius of curvature $R_{136}$ from the first transition point $P_{T1}$ to the second transition point $P_{T2}$.

The substantially flat portion 138 of the bladder 106 defines an elongate portion of the bladder 106 extending from the second transition point $P_{T2}$ to the second end 132 of the bladder 106. Thus, the substantially flat portion 138 extends from the mid-foot region 14 to the heel region 16. As discussed in greater detail below, when the bladder 106 is incorporated into the sole structure 100, the substantially flat portion 138 extends to and is exposed at the posterior end 20 of the sole structure 100 through an opening or gap formed between the upper cushioning element 110 and the lower cushioning element 112.

As best shown in FIGS. 3 and 4, the bladder 106 may include a peripheral rib 140 extending continuously along an outer perimeter of the bladder 106. Here, the peripheral rib 140 is defined by a portion of the bladder 106 adjacent to the peripheral seam 120 having a greater thickness $T_{140}$ (FIG. 7) than a thickness $T_{141}$ of an interior portion 141 of the bladder 106 associated with the tensile element 122. In the illustrated example, the peripheral rib 140 is continuous and completely bounds the outer periphery of the bladder 106. Thus, the peripheral rib 140 is associated with a portion of the bladder 106 that defines the peripheral surface 115.

Referring now to FIGS. 1-4, the bladder 106 of the midsole 102 is disposed within the chassis 108 between the upper cushioning element 110 and the lower cushioning element 112. The upper cushioning element 110 extends from a first end 146 at the anterior end 18 of the sole structure 100 to a second end 148 at the posterior end 20 of the sole structure 100. The upper cushioning element 110 includes a top side 150 configured to face the upper 300 and define the footbed of the article of footwear 10. The upper cushioning element 110 further includes a lower side 152 disposed on an opposite side from the top side 150 (i.e., facing away from the upper 300) and configured to interface with the upper barrier layer 114 of the bladder 106. A peripheral side surface 154 of the upper cushioning element 110 extends between the top side 150 and the lower side 152 and defines a peripheral profile of the upper cushioning element 110.

As best shown in FIG. 4, the lower side 152 of the upper cushioning element 110 includes an upper toe pad 156 disposed at the first end 146 and an upper pocket 158 extending between the upper toe pad 156 and the second end 148. The upper toe pad 156 may be described as having a thickness depending or protruding from the lower side 152 and having a length extending along the peripheral side surface 154 around the first end 146 of the upper cushioning element 110, from a first end on the medial side 22 to a second end on the lateral side 24. Thus, when the sole structure 100 is assembled, the upper toe pad 156 encompasses the first end 130 of the bladder 106 and defines an anterior end of the upper pocket 158.

The upper pocket 158 is generally configured to interface with or receive the upper barrier layer 114 of the bladder 106. In the illustrated example, the upper pocket 158 includes an upper peripheral channel 160 extending continuously along a periphery of the upper pocket 158. The upper peripheral channel 160 has a profile (e.g., size, shape) corresponding to a profile of a portion of the peripheral rib 140 defined by the upper barrier layer 114 such that the upper peripheral channel 160 is configured to receive an upper portion of the peripheral rib 140 when the sole structure 100 is assembled.

Figure 2:
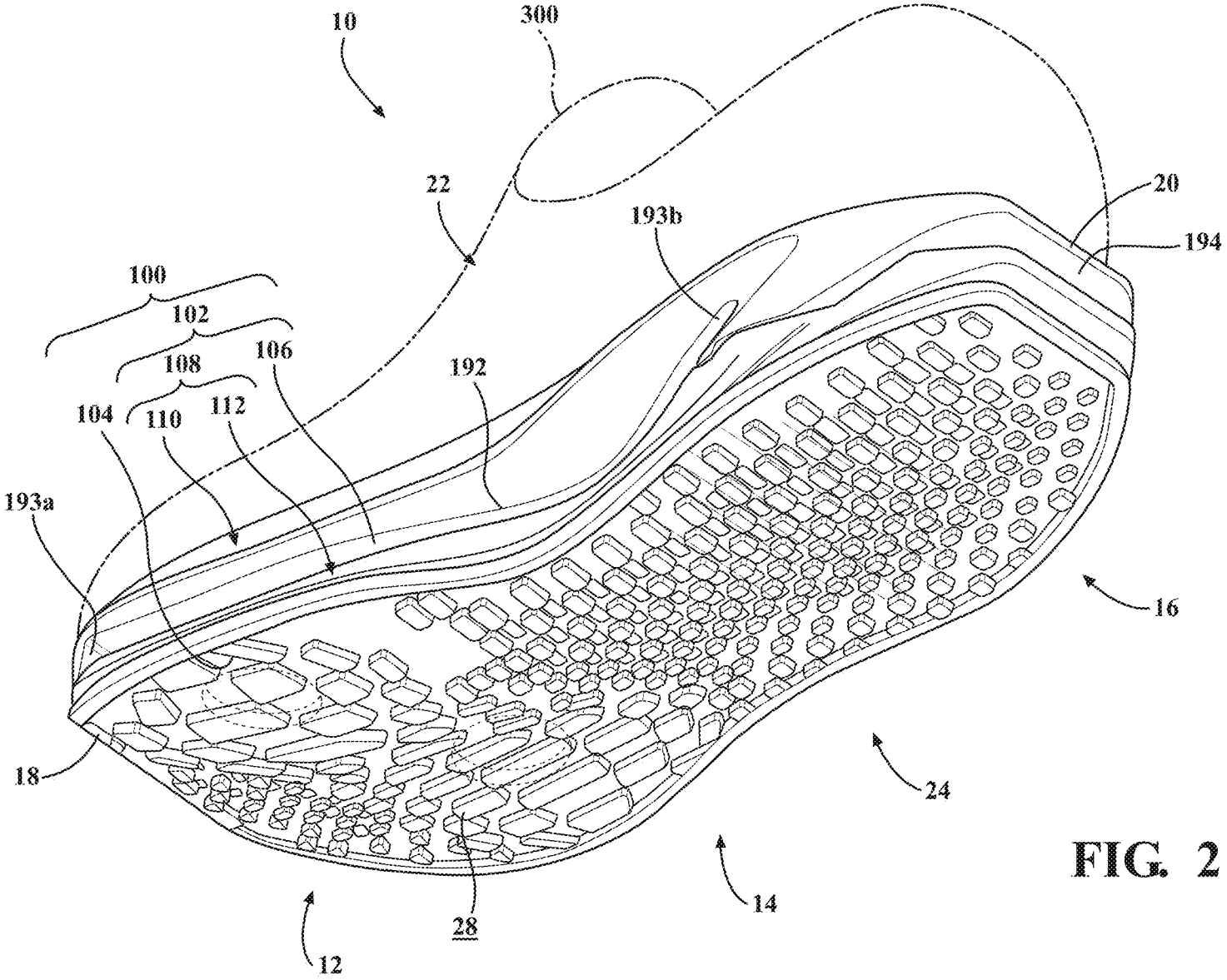
FIG. 2 is a medial side perspective view of the article of footwear of FIG. 1.

Referring to FIGS. 1 and 2, the peripheral side surface 154 of the upper cushioning element 110 includes a pair of wings 162*a*, 162*b* that extend from the lower side 152 and at least partially encompass a peripheral portion of the peripheral rib 140. For example, the upper cushioning element 110 includes a medial heel wing 162*a* extending over the peripheral rib 140 in the heel region 16 along the medial side 22 and a lateral heel wing 162*b* extending over the peripheral rib 140 in the heel region 16 along the lateral side 24. Each of the wings 162*a*, 162*b* extends from the lower side 152 of the upper cushioning element 110 to a respective distal end 163*a*, 163*b* that faces in the same direction as the lower side 152 (i.e., towards the outsole 104). As discussed below, the distal ends 163*a*, 163*b* of the wings 162*a*, 162*b* extend around the peripheral rib 140 of the bladder 106 and are configured to mate with the lower cushioning element 112. Thus, the wings 162*a*, 162*b* provide additional engagement between the upper cushioning element 110 and the bladder 106, thereby increasing stability along regions of the foot that experience greater loads during lateral movements (e.g., cutting, turning).

With continued reference to FIGS. 1-4, the lower cushioning element 112 extends from a first end 170 at the anterior end 18 of the sole structure 100 to a second end 172 at the posterior end 20 of the sole structure 100. The lower cushioning element 112 includes an upper side 174 configured to face the bladder 106 and a bottom side 176 disposed on an opposite side from the upper side 174 (i.e., facing away from the upper) and configured to interface with the outsole 104. A peripheral side surface 178 extends between the upper side 174 and the bottom side 176 and defines a peripheral profile of the lower cushioning element 112.

As best shown in FIG. 3, the upper side 174 of the lower cushioning element 112 includes a peripheral rim 180 protruding from the upper side 174 along the peripheral side surface 178 and extending continuously around an outer periphery of the upper side 174. Accordingly, the peripheral rim 180 and the upper side 174 cooperate to define a lower pocket 182 extending from the first end 170 of the lower cushioning element 112 to the second end 172 of the lower cushioning element 112. When the sole structure 100 is assembled, the peripheral rim 180 cooperates with the upper toe pad 156 of the upper cushioning element 110 to provide a solid cushioning element in the toe portion 12*r* of the sole structure 100. Accordingly, the peripheral rim 180 forms a lower toe pad at the anterior end 18 of the sole structure 100

The lower pocket 182 is generally configured to receive the lower barrier layer 116 of the bladder 106. In the illustrated example, the lower pocket 182 includes a lower peripheral channel 184 extending continuously along a periphery of the lower pocket 182, adjacent to the peripheral rim 180. The lower peripheral channel 184 has a profile (e.g., size, shape) corresponding to a profile of a portion of the peripheral rib 140 defined by the lower barrier layer 116 such that the lower peripheral channel 184 is configured to receive a lower portion of the peripheral rib 140 when the sole structure 100 is assembled.

The lower cushioning element 112 may include a plurality of forefoot apertures 186, 188 arranged in the forefoot region 12. Each of the apertures 186, 188 defines a cylindrical profile extending through a thickness $T_{112}$ of the lower cushioning element 112 from the upper side 174 to the bottom side 176. As shown, the apertures 186, 188 are generally aligned with each other along the metatarsophalangeal axis $A_{MTP}$ of the sole structure 100, which is configured to align with a metatarsophalangeal joint of the foot when the article of footwear 10 is donned by a user. Here, the apertures 186, 188 include a first aperture 186 arranged on the medial side 22 of the longitudinal axis $A_{100}$ and a second aperture 188 arranged on the lateral side 24 of the longitudinal axis $A_{100}$. As discussed below, the apertures 186, 188 receive corresponding protrusions 204, 206 of the outsole 104 to support respective metatarsophalangeal joints of the foot on the medial side 22 and the lateral side 24 of the sole structure 100.

The lower cushioning element 112 further includes a pair of sockets 189*a*, 189*b* formed in the peripheral side surface 178 on opposite sides 22, 24 in the heel region 16. Each socket 189*a*, 189*b* includes a recess or channel formed in the peripheral side surface 178, which is configured to receive or mate with a corresponding one of the wings 162*a*, 162*b* of the upper cushioning element 110 when the sole structure 100 is assembled. Thus, as shown in FIGS. 1 and 2, the wings 162*a*, 162*b* mate with the sockets 189*a*, 189*b* such that the distal ends 163*a*, 163*b* are seated against a bottom terminal end of the corresponding socket 189*a*, 189*b*. The interface between the wings 162*a*, 162*b* and the sockets 189*a*, 189*b* provides a direct mechanical interface between the upper cushioning element 110 and the lower cushioning element 112 in the heel region 16, whereby the lower cushioning element 112 is captured or restrained in the lateral direction (i.e., transverse to the longitudinal axis $A_{100}$) in the heel region 16. This interface minimizes relative lateral movement between the upper cushioning element 110 and the lower cushioning element 112 in the heel region 16 during application of lateral forces (e.g., lateral foot plant).

With reference to FIGS. 1, 2, and 6-9, when the sole structure 100 is assembled, an upper surface of the bladder 106 defined by the upper barrier layer 114 is attached to the upper cushioning element 110 within an interior region associated with the upper pocket 158 such that the peripheral surface 115 of the bladder 106 (i.e., the portion extending between the upper and lower surfaces defined by the barrier layers 114, 116) is inwardly offset from the peripheral side surface 158 of the upper cushioning element 110. In other words, the upper cushioning element 110 may be described as including an upper peripheral portion 168 that overhangs or extends outwardly from the peripheral surface 115 of the bladder 106. Likewise, a lower surface of the bladder 106 defined by the lower barrier layer 116 is attached to the lower cushioning element 112 within an interior region associated with the lower pocket 182 such that the peripheral surface 115 of the bladder 106 is inwardly offset from the peripheral side surface 178 of the lower cushioning element 112. Thus, like the upper cushioning element 110, the lower cushioning element 112 may be described as including a lower peripheral portion 190 that extends outwardly from the peripheral surface 115 of the bladder 106.

As shown in the figures, the lower peripheral portion 190 is spaced apart from and opposes the upper peripheral portion 168 to define a pair of peripheral channels 192 of the chassis 108 that each extend continuously along the sole structure 100 from a respective first end 193*a* defined by the toe pads 156, 180 to a corresponding second end 193*b* defined by the wings 162*a*, 162*b* in the heel region 16 on each side 22, 24 of the sole structure 100. Similarly, the lower peripheral portion 190 is spaced apart from and opposes the upper peripheral portion 168 at the posterior end 20 of the sole structure 100 to define a posterior opening 194 between the wings 162*a* 162*b* through which the second end 132 of the bladder 106 is exposed. Thus, the upper cushioning element 110 and the lower cushioning element 112 are not directly attached to each other in the ball portion $\mathbf{12}_B$, the mid-foot region 14, or at the posterior end 20. Instead, in these regions of the sole structure 100, the bladder 106 provides the only interface between the upper cushioning element 110 and the lower cushioning element 112. By utilizing the bladder 106 as the support interface between the upper cushioning element 110 and the lower cushioning element 112, the sole structure 100 provides a relatively high degree of lateral compliance by allowing the upper cushioning element 110 to shift independently from the lower cushioning element 112 in the ball portion $\mathbf{12}_B$, the mid-foot region 14, and the posterior end 20. Further, by configuring the bladder 106 with an unconstrained peripheral surface 115, the bladder 106 may provide improved cushioning by allowing the peripheral surface 115 to expand or distend into the peripheral channel 192 under compressive loads.

As described above, the cushioning elements 110, 112 include a resilient polymeric material, such as foam or rubber, to impart properties of cushioning, responsiveness, and energy distribution to the foot of the wearer. Example resilient polymeric materials for the cushioning elements 110, 112 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for barrier layers 114, 116. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The outsole 104 is attached to the bottom surface of the lower cushioning element 112 and is configured to provide the ground-contacting surface 28 of the sole structure 100. In the illustrated example, the outsole 104 extends continuously from a first end 196 at the anterior end 18 of the sole structure 100 to a second end 198 at the posterior end 20 of the sole structure 100. The outsole 104 further includes a top side 200 attached to the bottom side 176 of the lower cushioning element 112 and a bottom side 202 formed on an opposite side from the top side 200 and defining the ground-contacting surface 28.

The outsole 104 includes a plurality of protrusions 204, 206 arranged in the forefoot region 12 and each corresponding to a respective one of the plurality of the apertures 186, 188. Each of the protrusions 204, 206 extends from the top side 200 of the outsole 104 and has a profile corresponding to the profile of the respective apertures 186, 188. Thus, in the illustrated example, the protrusions 204, 206 have a cylindrical profile corresponding to the cylindrical profile of the apertures 186, 188, whereby the protrusions 204, 206 are configured to extend through the apertures 186, 188 to support the lower barrier layer 116 of the bladder 106. As shown, the protrusions 204, 206 are generally aligned with each other along the metatarsophalangeal axis $A_{MTP}$ of the sole structure 100, which is configured to align with a metatarsophalangeal joint of the foot when the article of footwear 10 is donned by a user. Here, the protrusions 204, 206 include a first protrusion 204 arranged on the medial side 22 of the longitudinal axis $A_{100}$ and a second protrusion 206 arranged on the lateral side 24 of the longitudinal axis $A_{100}$. The first protrusion 204 has a height $H_{204}$ extending from the top side 200 of the outsole 104 to a distal top surface 208 that contacts the lower barrier layer 116 of the bladder 106 along the curved portion 134 on the medial side 22. The first protrusion 204 includes a cylindrical peripheral side surface 210 extending between the top side 200 of the outsole 104 and the distal top surface 208 of the first protrusion 204. The second protrusion 206 has a height $H_{206}$ extending from the top side 200 of the outsole 104 to a distal top surface 212 that contacts the lower barrier layer 116 of the bladder 106 along the curved portion 134 on the lateral side 24. The second protrusion 206 includes a cylindrical peripheral side surface 214 extending between the top side 200 of the outsole 104 and the top surface 212 of the second protrusion 206. The heights $H_{204}$, $H_{206}$ of the protrusions 204, 206 are equal to the thickness $T_{112}$ of the lower cushioning element 112 at each of the respective apertures 186, 188, whereby the distal ends 208, 212 are flush with portions of the upper side 174 of the lower cushioning element 112 adjacent to the apertures 186, 188.

As discussed previously, the plurality of the apertures 186, 188 and the corresponding protrusions 204, 206 are aligned along the MTP axis $A_{MTP}$, whereby the sole structure 100 is configured such that the protrusions 204, 206 of the outsole 104 support the bladder 106 along the MTP axis $A_{MTP}$ on the medial side 22 and the lateral side 24. In the illustrated example, the sole structure 100 includes a pair of the apertures 186, 188 and the corresponding protrusions 204, 206. The first aperture 186 and first protrusion 204 are configured to support the first metatarsophalangeal joint of the foot (i.e., the big toe) while the second aperture 188 and second protrusion 206 are configured to support one or more of the metatarsophalangeal joints on the lateral side 24 of the foot. By providing a direct interface between the protrusions 204, 206 of the outsole 104 and the lower barrier layer 116, the bladder 106 receives direct feedback from the ground surface along the metatarsophalangeal joint, thereby providing increased responsiveness of the sole structure 100 in the forefoot region of the sole structure 100 relative to sole structures where the bladder 106 is fully isolated from the outsole 104.

While the protrusions 204, 206 are described as being aligned along the MTP axis $A_{MTP}$, the protrusion 204 disposed closer to the medial side 22 is disposed closer to the anterior end 18 than the protrusion 206 disposed closer to the lateral side 24. Accordingly, the protrusion 206 disposed closer to the lateral side 24 is disposed closer to the posterior end 20 than the protrusion 204 disposed closer to the medial side 22. The foregoing relationship results in the protrusions 204, 206 being offset from one another in a direction extending along the longitudinal axis $A_{10}$ of the footwear 10.

The upper 300 is attached to the sole structure 100 and includes interior surfaces that define an interior void configured to receive and secure a foot for support on the sole structure 100. The upper 300 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

In use, the protrusions 204, 206 provide a point load on the bladder 106 when a force is exerted on the sole structure 100, thereby reducing the force required to deform the bladder 106. Namely, as the outsole 104 is formed from a more rigid material than the material of the lower cushioning element 112, and the protrusions 204, 206 include a smaller area-of-contact with the lower barrier layer 116 of the bladder 106 as compared to the area-of-contact between the lower cushioning element 112 and the lower barrier layer 116 of the bladder 106, the protrusions 204, 206 more easily compress the bladder 106 under the applied load. In so doing, less force is required to compress the bladder 106 and, as such, bladders containing higher pressure can be implemented in the sole structure 100 and/or the same bladder can be used with smaller people who apply less load on the sole structure 100 during use. In short, the reduced load applied by smaller people on the sole structure 100 will still cause compression of the bladder 106 due to interaction between the protrusions 204, 206 and the bladder 106.

The following Clauses provide exemplary configurations for an article of footwear, a bladder for an article of footwear, or a sole structure for an article of footwear described above.

Clause 1. A sole structure for an article of footwear, the sole structure defining a footbed and comprising a chassis including a lower cushioning element having an upper side and a bottom side disposed on an opposite side from the upper side, the lower cushioning element including one or more apertures extending from the upper side to the bottom side, a bladder disposed adjacent to the upper side of the lower cushioning element, and an outsole disposed adjacent to the bottom side of the lower cushioning element and including one or more protrusions each extending through a respective one of the one or more apertures and engaging the bladder.

Clause 2. The sole structure of Clause 1, wherein the one or more protrusions includes a first protrusion disposed on a medial side of the sole structure and a second protrusion disposed on a lateral side of the sole structure.

Clause 3. The sole structure of Clause 2, wherein each of the first protrusion and the second protrusion are aligned along a metatarsophalangeal axis of the sole structure.

Clause 4. The sole structure of any of Clauses 1-3, wherein each of the one or more protrusions extends from a top side of the outsole to a distal end surface in contact with the bladder.

Clause 5. The sole structure of Clause 4, wherein the distal end surface is planar.

Clause 6. The sole structure of Clause 5, wherein the bladder includes a first curved portion in a forefoot region of the sole structure and a substantially flat portion in a heel region of the sole structure.

Clause 7. The sole structure of Clause 6, wherein the distal end surface of each of the one or more protrusions contacts the bladder at the first curved portion.

Clause 8. The sole structure of any of the preceding Clauses, wherein the chassis includes an upper cushioning element disposed on an opposite side of the bladder from the lower cushioning element.

Clause 9. The sole structure of Clause 8, wherein the bladder is exposed between the upper cushioning element and the lower cushioning element along at least one of a medial side of the sole structure or a lateral side of the sole structure.

Clause 10. The sole structure of Clause 8, wherein the bladder is exposed between the upper cushioning element and the lower cushioning element at a posterior end of the sole structure.

Clause 11. A sole structure for an article of footwear, the sole structure defining a footbed and comprising a chassis including a lower cushioning element having an upper side and a bottom side disposed on an opposite side from the upper side, the lower cushioning element including a plurality of apertures extending from the upper side to the bottom side, a bladder disposed adjacent to the upper side of the lower cushioning element, and an outsole disposed adjacent to the bottom side of the lower cushioning element and including a plurality of protrusions each extending through a respective one of the plurality of apertures, supporting the bladder, and being offset from one another in a direction extending along a longitudinal axis of the sole structure.

Clause 12. The sole structure of Clause 11, wherein the plurality of protrusions includes a first protrusion disposed on a medial side of the sole structure and a second protrusion disposed on a lateral side of the sole structure.

Clause 13. The sole structure of Clause 12, wherein each of the first protrusion and the second protrusion are aligned along a metatarsophalangeal axis of the sole structure.

Clause 14. The sole structure of any of Clauses 11-13, wherein each of the plurality of protrusions extends from a top side of the outsole to a distal end surface in contact with the bladder.

Clause 15. The sole structure of Clause 14, wherein the distal end surface is planar.

Clause 16. The sole structure of Clause 15, wherein the bladder includes a first curved portion in a forefoot region of the sole structure and a substantially flat portion in a heel region of the sole structure.

Clause 17. The sole structure of Clause 16, wherein the distal end surface of each of the plurality of protrusions contacts the bladder at the first curved portion.

Clause 18. The sole structure of any of the preceding Clauses, wherein the chassis includes an upper cushioning element disposed on an opposite side of the bladder from the lower cushioning element.

Clause 19. The sole structure of Clause 18, wherein the bladder is exposed between the upper cushioning element and the lower cushioning element along at least one of a medial side of the sole structure or a lateral side of the sole structure.

Clause 20. The sole structure of Clause 18, wherein the bladder is exposed between the upper cushioning element and the lower cushioning element at a posterior end of the sole structure.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure defining a footbed and comprising:

a chassis including a lower cushioning element having an upper side and a bottom side disposed on an opposite side from the upper side to define a thickness of the lower cushioning element, the lower cushioning element including one or more apertures extending from the upper side to the bottom side;

a bladder disposed adjacent to the upper side of the lower cushioning element; and an outsole disposed adjacent to the bottom side of the lower cushioning element and including one or more protrusions each extending through a respective one of the one or more apertures and directly engaging the bladder, each of the one or more protrusions having a height equal to the thickness of the lower cushioning element such that the one or more protrusions are flush with portions of the upper side of the lower cushioning element adjacent to the apertures.

2. The sole structure of claim 1, wherein the one or more protrusions includes a first protrusion disposed on a medial side of the sole structure and a second protrusion disposed on a lateral side of the sole structure.

3. The sole structure of claim 2, wherein the first protrusion and the second protrusion are aligned along a metatarsophalangeal axis of the sole structure.

4. The sole structure of claim 1, wherein each of the one or more protrusions extends from a top side of the outsole to a distal end surface in contact with the bladder.

5. The sole structure of claim 4, wherein the distal end surface is planar.

6. The sole structure of claim 5, wherein the bladder includes a first curved portion in a forefoot region of the sole structure and a substantially flat portion in a heel region of the sole structure.

7. The sole structure of claim 6, wherein the distal end surface of each of the one or more protrusions contacts the bladder at the first curved portion.

8. The sole structure of claim 1, wherein the chassis includes an upper cushioning element disposed on an opposite side of the bladder from the lower cushioning element.

9. The sole structure of claim 8, wherein the bladder is exposed between the upper cushioning element and the lower cushioning element along at least one of a medial side of the sole structure or a lateral side of the sole structure.

10. The sole structure of claim 8, wherein the bladder is exposed between the upper cushioning element and the lower cushioning element at a posterior end of the sole structure.

11. A sole structure for an article of footwear, the sole structure defining a footbed and comprising:

a chassis including a lower cushioning element having an upper side and a bottom side disposed on an opposite side from the upper side to define a thickness of the lower cushioning element, the lower cushioning element including a plurality of apertures extending from the upper side to the bottom side;

a bladder disposed adjacent to the upper side of the lower cushioning element; and an outsole disposed adjacent to the bottom side of the lower cushioning element and including a plurality of protrusions each extending through a respective one of the plurality of apertures, directly supporting the bladder, and being offset from one another in a direction extending along a longitudinal axis of the sole structure, each protrusion of the plurality of protrusions having a height equal to the thickness of the lower cushioning element such that the protrusions are flush with portions of the upper side of the lower cushioning element adjacent to the apertures.

12. The sole structure of claim 11, wherein the plurality of protrusions includes a first protrusion disposed on a medial side of the sole structure and a second protrusion disposed on a lateral side of the sole structure.

13. The sole structure of claim 12, wherein the first protrusion and the second protrusion are aligned along a metatarsophalangeal axis of the sole structure.

14. The sole structure of claim 11, wherein each of the plurality of protrusions extends from a top side of the outsole to a distal end surface in contact with the bladder.

15. The sole structure of claim 14, wherein the distal end surface is planar.

16. The sole structure of claim 15, wherein the bladder includes a first curved portion in a forefoot region of the sole structure and a substantially flat portion in a heel region of the sole structure.

17. The sole structure of claim 16, wherein the distal end surface of each of the plurality of protrusions contacts the bladder at the first curved portion.

18. The sole structure of claim 11, wherein the chassis includes an upper cushioning element disposed on an opposite side of the bladder from the lower cushioning element.

19. The sole structure of claim 18, wherein the bladder is exposed between the upper cushioning element and the lower cushioning element along at least one of a medial side of the sole structure or a lateral side of the sole structure.

20. The sole structure of claim 18, wherein the bladder is exposed between the upper cushioning element and the lower cushioning element at a posterior end of the sole structure.

* * * * *